US006019333A

United States Patent [19]

Waller

[11] Patent Number: 6,019,333

[45] Date of Patent: Feb. 1, 2000

[54] TRANSOM TRANSDUCER HOLDER

[76] Inventor: Eugene Waller, 110 Shore Ct, 208B, North Palm Beach, North Palm Beach, Fla. 33408

[21] Appl. No.: 09/177,716

[22] Filed: Oct. 22, 1998

[51] Int. Cl.[7] ..... A47F 1/10

[52] U.S. Cl. ..... 248/295.11; 248/640; 114/343; 367/173; 440/6

[58] Field of Search ..... 248/284.1, 291, 248/295.11, 292.14, 296.1, 297.21, 640, 641, 642, 643, 644, 327, 328, 317; 367/173; 440/6; 114/343

[56] References Cited

U.S. PATENT DOCUMENTS

| | | | |
|---|---|---|---|
| 2,837,727 | 6/1958 | Mayes . | |
| 4,285,485 | 8/1981 | Burke | 248/291 |
| 4,735,166 | 4/1988 | Dimalanta | 440/6 X |
| 4,825,485 | 5/1989 | Burke | 248/291 |
| 4,928,915 | 5/1990 | Havins | 248/295.1 X |
| 4,979,153 | 12/1990 | Terry | 367/93 |
| 4,982,924 | 1/1991 | Havins | 248/295.1 X |
| 5,182,732 | 1/1993 | Pichowkin | 367/173 |
| 5,186,428 | 2/1993 | Falkenberg | 248/284 |
| 5,277,630 | 1/1994 | Clark | 440/6 |
| 5,551,899 | 9/1996 | Hatcher | 440/6 |
| 5,573,221 | 11/1996 | Reeves | 248/640 |

*Primary Examiner*—Ramon O. Ramirez
*Assistant Examiner*—Tan Le
*Attorney, Agent, or Firm*—McHale & Slavin, PA

[57] ABSTRACT

A retractable, vertically-aligned, transom-mounted transducer holding device that allows for the movement of a transducer, or similar sensing devices, from beneath a boat hull into a position raised above the waterline of the boat is disclosed. A bifurcated alignment rail allows slidable positioning of a non-metal support plate along the length of the rail. The support plate is selectively positioned along the support rails via a mechanical lever. The support plate may be placed in an operating position, at the lower end of the rails, or in a storage position, at the top portion of the rail.

7 Claims, 2 Drawing Sheets

TRANSOM TRANSDUCER HOLDER

FIELD OF THE INVENTION

This invention is related to the field of boating and, in particular, to a retractable positioning and holding device securable to the transom of a boat for use with transducers and the like items positionable in the water.

BACKGROUND OF THE INVENTION

Boating is both a recreational and commercial activity that typically requires the placement of various devices beneath the waterline of the boat. Such devices may include electronic sensors to determine the depth of the water, sonar for determining fish activity, temperature probe, speed detector, and so forth. The majority of these devices are commonly electronic transducers. Due to their sensitive nature, these transducers are susceptible to damage from a variety of sources.

On many boats, transducers are permanently mounted to a boat hull with the sensing unit placed beneath the water. Transducers in this location are especially prone to damage, including impact from items in the water and/or various parts of a boat trailer during loading or unloading. Even once a boat is placed securely on a trailer, flying debris may strike the transducer while the boat is being transported.

Transducers are also the target of marine growth. If a boat is stored in water, marine growth, such as mussels or barnacles, can easily coat the transducer, causing a complete loss of operation. Although there are various transducer paints available, anti-fouling paint will reduce a transducer's functionality.

In addition, transducer mounts may include flow measuring devices such as a paddle wheel. A paddle wheel allows boaters to determine the speed of the boat in relation to the water with a sensor for use in determining paddle wheel rotation. Like transducers, flow measuring devices are also sensitive; even a single barnacle can prevent proper functioning.

For these reasons, various retractable mounting units are available. Many units are designed for small boats and are not appropriate for use on faster boats or boats that travel in rough seas. For instance, U.S. Pat. No. 4,285,485 discloses a retractable sonar sensing system which essentially consists of a C-clamp type bracket having a pivotable arm that allows the sensing unit to be rotated up and out of the water. This device requires a narrow transom wall in order for the bracket to be properly seated. The device does not provide rigidity and could not be used with larger or multiple engine boats. The device also does not provide enough stability to allow transducer operation in rough water conditions.

U.S. Pat. No. 5,186,428 discloses another transducer retractor device. This device includes a pivot mechanism employing an articulation point for placement of the transducer at 90 degree increments. This device fails to accommodate deep "V" type boats or boats that employ a swim platform. Further, the device inhibits movement and will not allow the transducer to clear the water while underway or in high seas. If the transducer in this device is rotated 90 degrees, and the boat is in a bow up, transom down position, the extended transducer will be damaged by water impact while the boat is underway.

Thus, what is lacking in the art is a device that allows a transducer to be placed along the transom of a boat while allowing movement of the transducer from beneath the water line to an area above the water line and maintain spacial distinction in relation to the transom.

SUMMARY OF THE INVENTION

The instant invention consists of a vertically mounted transducer holder comprising a first and second rail, forming a mirror image, securable to the transom of a boat in a vertical orientation. The rails are maintained in a parallel position and secured to the transom by fasteners, such as gelcoat screws.

A support plate of non-metallic material is slidably positioned between the rails. The leading edge of the support block includes angular corners which are operatively associated with complementary alignment wedges located within at the bottom of each rail. The angular corners and alignment wedges are used to position the support block in a central position when the support block is placed in a lowered position. The support block is movable between a top end and bottom end of the rails by use of a positioning rod with a connecting handle. The positioning rod is rotatable and placed through an alignment block having a centrally disposed aperture. The support block is universal and allows for the securement of most any item thereto.

Thus, an objective of the instant invention is to provide a support plate for raising a transducer from a position lockable beneath the water line to a position lockable above the water line.

Still another objective of the instant invention is to maintain the transducer in a fixed position relative to the transom of the boat preventing cantilevered-type movement when in lowered position, and to protect the transducer from damage while in a raised position.

Still another objective of the instant invention is to use a support plate that has no pivoting parts and is self-centering.

Yet still another objective of the instant invention is to use a support plate having a leading edge capable of providing a self cleaning action while placed into a lowered position.

Yet still another objective of the instant invention is to disclose a simplistic support bracket that is inexpensive to manufacture, requires no service, takes minimal space along the transom wall.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
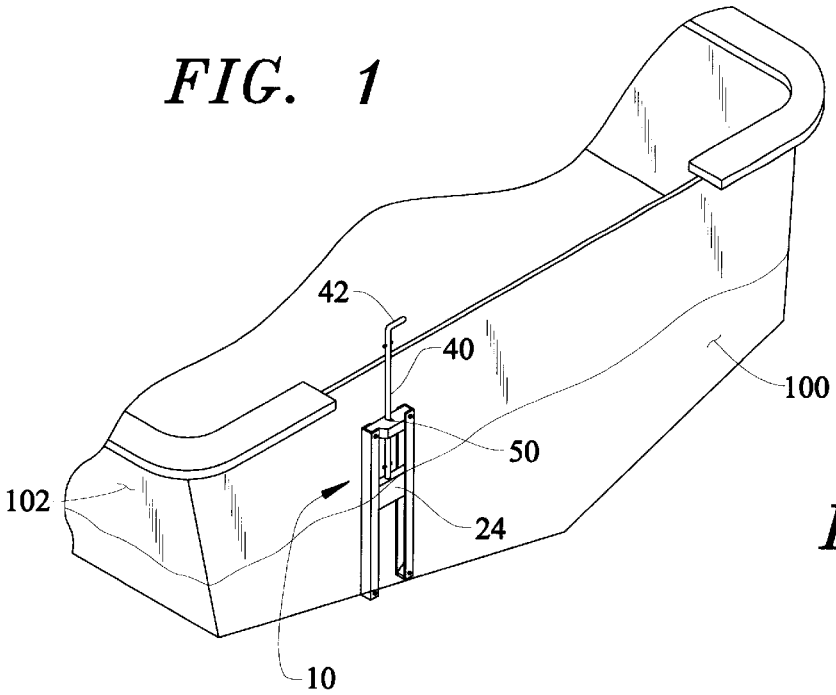
FIG. 1 is a partial pictorial view of the transducer positioning and holding device of the present invention, shown mounted on the transom of a boat.
Figure 2:
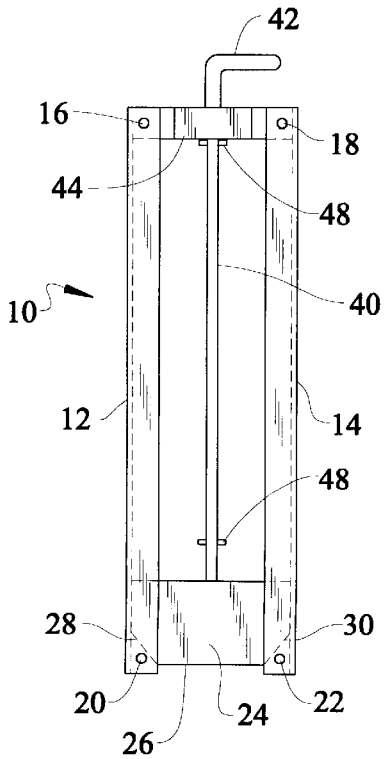
FIG. 2 is an elevation view of the transducer positioning and holding device shown in FIG. 1, with the support plate in a lowered position.
Figure 3:
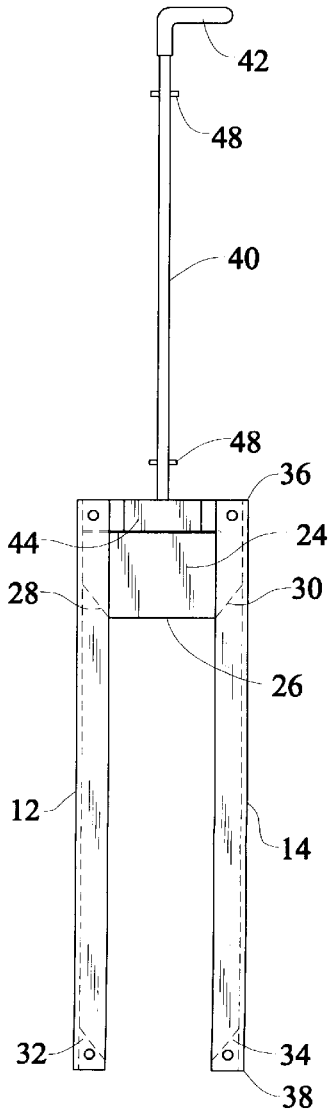
FIG. 3 is an elevation view of the transducer positioning and holding device shown in FIG. 1, with the support plate in a raised position.
Figure 4:
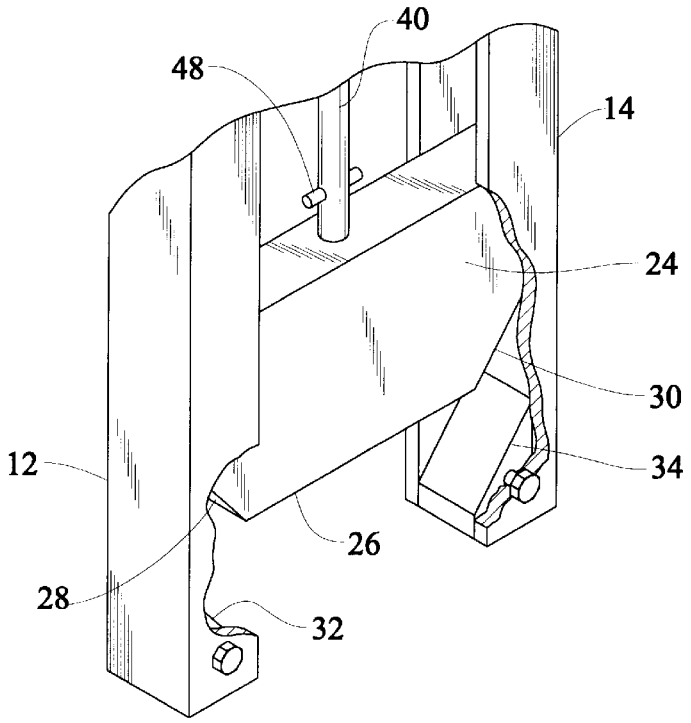
FIG. 4 is partial close-up view of the transducer positioning and holding device shown in FIG. 1, showing detail of the support plate and alignment wedge relationship.

Although the invention will be described in terms of a specific embodiments, it will be readily apparent to those skilled in this art that various modifications, rearrangements and substitutions can be made without departing from the spirit of the invention. The scope of the invention is defined by the claims appended hereto.

Now referring to FIGS. 1 through 4, depicted is the transom 100 of a boat 102 with the retractable transducer holder 10 of the instant invention secured to the transom 100. The retractable transducer holder 10 is formed from a first rail 12 and second rail 14 secured to the transom 100 in a vertical orientation. The second rail 14 forms a mirror image of the first rail 12.

The rails 12, 14 are constructed of rigid C-sectioned channels that face inwardly, so that the opening of each channel is directed to the opening of the opposite channel. The rails 12, 14 are preferably constructed from aluminum and mounted by use of fasteners, such as gelcoat screws, shown located along the upper edge 16 of the first rail 12 and the upper edge 18 of the second rail 14. Similarly, fasteners are placed along the lower edge 20 of the first rail 12 and the lower edge 22 of the second rail 14.

A support plate or block 24 of non-metallic material is slidably disposed between rails 12 and 14. The leading edge 26 of the support plate 24 includes angular corners 28 and 30 which are associated with a pair of alignment wedges 32 and 34 located along the bottom of each rail. The alignment wedges 32,34 are held in position by fasteners 20 and 22. It is noted that each wedge 32, 34 further provides for spacial support, preventing collapse of the channels should the fasteners 20 and 22 be over tightened.

The angular corners 28 and 30 and alignment wedges 32 and 34 are used to centrally position the support block 24 when placed in a lowered, operating, position. The support block 24 is movable between the top end 36 end and bottom end 38 of the rails 12, 14 by use of a positioning rod 40 having a handle 42. The positioning rod 40 is rotatable and placed through an alignment block 44 having a centrally-disposed, contoured vertical aperture 50.

The positioning rod 40 may be locked in a raised position or a lowered position via posts 48 that extend orthogonally from the upper and lower portions of the rod 40. Rotating the positioning rod 40 changes the orientation of the posts 48 with respect to the vertical aperture 50. When the posts 48 are aligned with the vertical aperture 50, the positioning rod 40 may be raised or lowered. Once raised or lowered, the positioning rod 40 may be selectively locked in place by turning the rod, via handle 42, until the posts 48 are no longer aligned with the aperture 50. It should be noted that any type of friction-inducing device may be used as the locking mechanism. For instance, the locking mechanism may include crimped sections of the positioning rod 40 that, like the posts 48 described above, are shaped to selectively engage the vertical aperture 50. The locking mechanisms may also include detentes in the rod 40 for engagement of a spring-loaded ball, not shown. Additionally, in waters having a low tendency of fouling, a support block 24 that frictionally engages the sidewalls of the rail channels 12, 14 can be used to prevent movement of the support block. The friction-inducing locking mechanism provides rigidity to the support block 24 while in a lowered position and prevents the unintentional movement of the support block when the block is placed in a raised, or stored position.

In use, the support block 24 is placed in a lowered, or operating, position by rotating the handle 42 to an orientation that will align the posts 48 with the vertical aperture 50, allowing manual movement of the support block 24. The handle 42 is then used to push the support block 24 downward until the angular corners 28 and 30 of the support block engage the alignment wedges 32 and 34. The handle 42 may then again be rotated to lock the rod 40 within the alignment block 44. When the support plate 24 is to be raised, the handle 42 is rotated and the rod 40 is raised. The rod 40 is rotatably secured within the support block 24, facilitating handle rotation 42 at the convenience of the operator.

Figure 5:
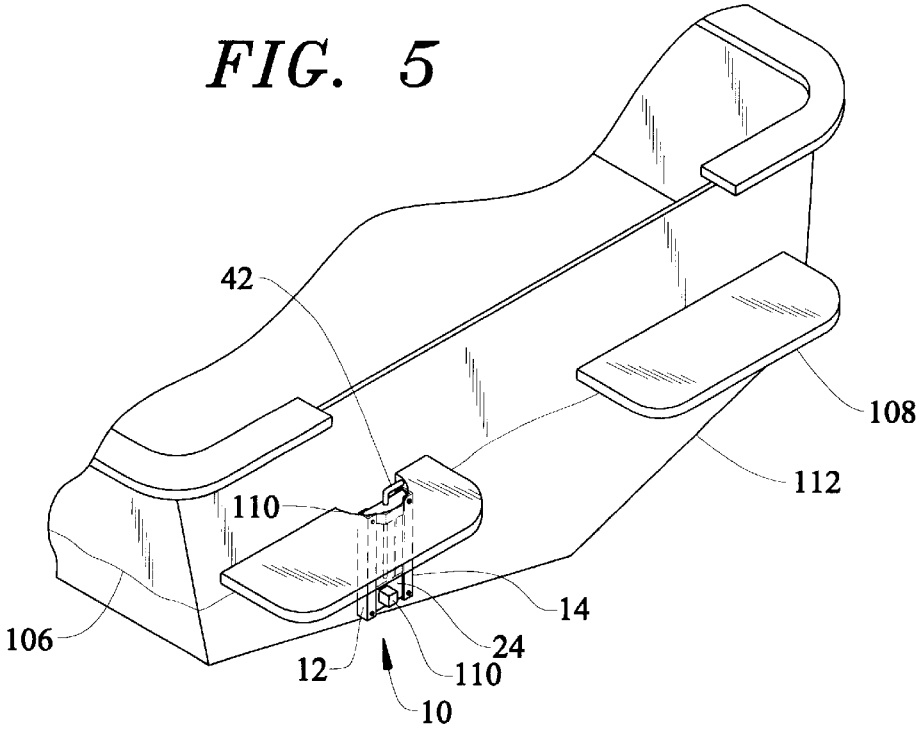
FIG. 5 is a partial pictorial view of the transducer positioning and holding device of the present invention shown passing through a swim platform and mounted on the transom of a boat.

Now referring to FIG. 5, the benefit of a flush and vertically mounted, retractable transducer holder 10 is depicted. In this illustration, the boat 106 includes a swim platform 108 having a small opening 110 to allow grasping of the handle. The opening 110 allows the handle to be grasped and raised, as previously mentioned, without taking any useable space from the swim platform. A transducer 110 is shown mounted on the support block 24, with the end of the transducer placed beneath the hull of the boat.

It is important to note that the instant invention remains flush against the transom wall 100, thereby avoiding interference with swim platforms, and beneficially eliminating the vibration associated with cantilever-type devices.

High-speed boats have a particular problem in that the mounting of a transducer 110 must be sufficiently rigid to minimize transducer vibration and prevent detachment of the transducer from the hull. This rigidity must be attained while allowing the transducer 110 to be moved when the boat will be removed from water or left stagnant in the water. The transducer 110 must also be movable when a boat will be operated in conditions where transducers are not necessary, or when sea conditions may cause damage to the transducer. For instance, if a powerful fishing boat, such as a 28 foot Grady White is crossing the Gulf Stream at 35 knots, there is no need for a depth finder as the depth is not readable by most conventional depth finders. However, the Gulf Stream is notorious for its high and unpredictable seas which can stress every aspect of a boat, including transducers. In these conditions, having the ability to lift the transducer out of the water not only keeps the transducer safe from possibly-damaging seas, it also lessens the drag on the boat, thereby increasing boat performance.

While a boat is being transported on a trailer, transponders are not used. However, hull-mounted transducers are prone to damage, especially when the boat is used with a drive-on style trailer. In these situations, the ability to lift a transducer away from the bottom of the boat will help protect the transducer from damage. Finally, should the boat be beached or operated in very shallow water, such as while fishing in the flats, it is important that the transducer be placed in a safe location. The retractable transducer holder 10 of the instant invention allows the movement necessary to keep the transducer safe in otherwise-damaging situations.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A retractable transducer holding device adapted to be mounted on an aft-facing vertical surface of a boat transom, said holding device comprising:

a pair of c-sectioned rails, securable to said vertical surface, said rails mounted in an upright vertical and parallel relation;

a support plate operatively associated with said rails, said support plate being slidable along the length of said rails;

a positioning rod to facilitate manual movement of said support plate between a lowered position at a first end of said rails and a raised position at a second end of said rails; and an alignment block for maintaining said positioning rod in a predetermined position above said support plate.

2. The retractable transducer holding device according to claim 1, wherein said rails are further defined as aluminum "C" shaped channels securable to said vertical surface of a boat transom.

3. The retractable transducer holding device according to claim 1, wherein said support plate is constructed from corrosion-resistant, non-metallic material allowing said support plate to slide between said rails.

4. The retractable transducer holding device according to claim 1 further including alignment wedges located along the first end of each of said rails, each of said alignment wedges being shaped to operatively engage an associated leading corner edge of said support plate, thereby maintaining said support plate at a predetermined location between said rails, when said support plate is in a lowered position.

5. The retractable transducer holding device according to claim 1, wherein said alignment block includes a provision for securing said positioning rod in a raised or lowered position.

6. The transducer device according to claim 1, wherein said alignment block includes a means for locking said positioning rod in a fixed position.

7. The transducer device according to claim 1 wherein said support plate is sized to house multiple electronic or mechanical components.

* * * * *